US006308943B1

(12) United States Patent
Fischer et al.

(10) Patent No.: US 6,308,943 B1
(45) Date of Patent: Oct. 30, 2001

(54) DEVICE FOR CLAMPING WORKPIECE TO A SURFACE

(75) Inventors: David Fischer, Aschaffenburg; Rudolf Kohlert, Stockstadt, both of (DE)

(73) Assignee: A. Roemheld GmbH & Co KG, Laubach (DE)

( * ) Notice: Subject to any disclaimer, the term of this patent is extended or adjusted under 35 U.S.C. 154(b) by 0 days.

(21) Appl. No.: 09/556,348

(22) Filed: Apr. 24, 2000

(30) Foreign Application Priority Data

Apr. 24, 1999 (DE) ..... 199 18 770

(51) Int. Cl.[7] ..... D23Q 3/08
(52) U.S. Cl. ..... 269/32; 269/24; 269/136
(58) Field of Search ..... 269/20, 22, 27, 269/32, 33, 35, 134, 136, 137, 138, 217, 229, 233, 234, 24

(56) References Cited

U.S. PATENT DOCUMENTS

| | | | | |
|---|---|---|---|---|
| 4,506,871 | * | 3/1985 | Yonezawa | 269/24 |
| 4,932,640 | * | 6/1990 | Shirkawa | 269/32 |
| 5,096,009 | * | 3/1992 | Hirmann | 180/8.1 |
| 5,174,554 | * | 12/1992 | Yonezawa | 269/24 |
| 5,374,041 | * | 12/1994 | Bernstein | 269/136 |
| 5,746,420 | | 5/1998 | Kohlert . | |
| 5,915,679 | | 6/1999 | Kohlert . | |

FOREIGN PATENT DOCUMENTS

| | | |
|---|---|---|
| 251439 | 1/1912 | (DE) . |
| 332373 | 3/1920 | (DE) . |
| 1646420 | 2/1952 | (DE) . |
| 1552707 | 7/1970 | (DE) . |
| 0620084 | 10/1994 | (EP) . |
| 4311857 | 10/1994 | (DE) . |
| 814647 | 3/1981 | (SU) . |

* cited by examiner

*Primary Examiner*—Joseph J. Hail, III
*Assistant Examiner*—Daniel Shanley
(74) *Attorney, Agent, or Firm*—W. F. Fasse; W. G. Fasse

(57) ABSTRACT

A clamping tool holds a workpiece in place on a surface, for example in a machine tool, by a clamping bolt (2) which is moved into a workpiece contacting position by a locking piston (6). The bolt (2) and the piston (6) are slidable in respective bores (3, 4) in a housing (1) in which the clamping bolt (2) is locked in a workpiece supporting position by the locking piston (5, 6). For this purpose the locking piston (6) has a piston rod (5) with a wedging incline (8) cooperating with a respective wedging incline (2') at an inner end of the clamping bolt (2). A tongue and groove combination is provided between the piston rod (5) and the inner end of the clamping bolt to facilitate the cooperation and force transmission between the piston rod (5) and the clamping bolt (2). A self-locking effect holds the locking piston in a working position until the self-locking effect is released.

17 Claims, 2 Drawing Sheets

DEVICE FOR CLAMPING WORKPIECE TO A SURFACE

PRIORITY CLAIM

This application is based on and claims the priority under 35 U.S.C. §119 of German Patent Application 199 18 770.3, filed on Apr. 24, 1999, the entire disclosure of which is incorporated herein by reference.

FIELD OF THE INVENTION

A clamping device holds a workpiece in place by a clamping bolt which in turn is locked in place by a locking piston cooperating with the clamping bolt through a wedging incline and a tongue and groove combination.

BACKGROUND INFORMATION

Clamping tools in which a clamping bolt is slidably mounted in a housing are known in the art. A locking piston is also slidably movable in the housing preferably at right angles to the clamping bolt. The position of the clamping bolt is accomplished by the cooperation of wedging inclines. One wedging incline is provided on the locking piston or rather on its piston rod, while the other wedging incline is provided on an inner end of the clamping bolt.

These clamping tools must make sure that the workpiece is securely held in place on a surface in such a way that during a machining operation the forces effective on the workpiece do not diminish or remove the clamping force.

European Patent Publication EP 0,620,084 and corresponding German Patent Laying-Open Publication 43 11 857 disclose a clamping tool for clamping workpieces by a clamping head that is slidingly guided on an inclined plane in such a way that the frictional forces between the plane and the clamping head are larger than the forces effective on the clamping head. The inclined plane is formed between a lower section of the clamping head that is formed into a pestle and the piston rod of a clamping force holding element extending crosswise to the force direction of the clamping head. In order to increase the frictional force in the area of the inclined plane a V-groove is formed in the wedging incline of the piston rod and the pestle is formed with wedging bevels sliding in the V-groove. In order to move the clamping head against the workpiece two hydraulic drives are required, one for the clamping head and one for the holding piston. The need for separate hydraulic drives results in a relatively large structural assembly. U.S. Pat. No. 5,746,420 (Kohlbert) discloses a similar device as just described.

U.S. Pat. No. 5,915,679 (Kohlert) discloses a support element for securing a workpiece on a supporting surface, for example in a machine tool. The support element comprises a support or holding bolt movably mounted in a housing. The bolt is moved into contact with a workpiece by an air stream. Once contact is established, the holding bolt is held in place by a hydraulic piston extending in the same housing at right angles to the holding bolt. When the hydraulic locking piston is released, the holding bolt is reset into a rest position by a spring. The workpiece is contacted under a manual throttle control of the air stream and firmly held in place by hydraulic pressure. Here again two sources of pressure, one hydraulic one pneumatic are required for the operation of the clamping tool.

There is a trend in the technology of clamping tools to make these tools ever smaller while maintaining their high efficiency in a structurally compact component.

OBJECTS OF THE INVENTION

In view of the above it is the aim of the invention to achieve the following objects singly or in combination:

- to construct the clamping tool as a compact element in which the required movements of a clamping bolt and a locking piston are accomplished by a single hydraulic drive system;
- to construct the clamping bolt and locking piston in such a way that a self-locking is effective when the clamping bolt is in its work position without any elastic yielding;
- to provide a compact workpiece holding tool that is easily adapted to all requirements that must be met by such clamping tools;
- to utilize a self-locking effect in such a way that the clamping bolt and locking piston will retain their working positions even if the hydraulic pressure that moved the locking piston into its working position becomes unavailable for whatever reason; and
- to keep the locking piston solely by a self-locking action in its working position independently of any reaction forces caused by the forces occurring when machining the workpiece.

SUMMARY OF THE INVENTION

According to the invention the above objects have been achieved by the combination of the following features. The present clamping device is characterized by a housing with a first bore in which a clamping bolt is slidably mounted to project out of the housing for contacting a workpiece. The housing has a second bore crossing the first bore and a locking piston is slidably movable in the second bore. The locking piston includes a piston rod provided with a first wedging incline. A second wedging incline is provided on an inner end of the clamping bolt inside the housing. The two wedging inclines cooperate with each other for locking the clamping bolt in a fixed working position in response to moving the locking piston and piston rod into a bolt locking position. A tongue and groove combination is provided between the piston rod and the inner end of the clamping bolt. The tongue and groove combination includes a tongue and a groove in which the tongue is guided in a force transmitting manner for facilitating the positioning of the clamping bolt by the locking piston. The groove comprises first and second groove portions interconnected by an open neck. The tongue comprises first and second tongue sections slidingly received in the first and second groove portions for slidingly guiding the tongue in the groove when the piston and piston rod are moved relative to the clamping bolt by pressure, such as hydraulic pressure applied either to one end or to the other end of the piston and piston rod.

It is an advantage of the invention that the locking piston with its rod assumes a self-locking position or condition when the clamping bolt has reached a workpiece contacting position. At that point the locking piston with its piston rod will retain this position independently of reaction forces generated by the machining of the workpiece and independently of any hydraulic pressure that brought the locking piston into its working position. The self-locking effect prevents the clamping bolt from moving out of the interlocking position until a release hydraulic pressure is introduced into a pressure chamber on the piston rod side of the locking piston in the second bore in the housing. The self-locking effect also is free of any elastic yielding.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
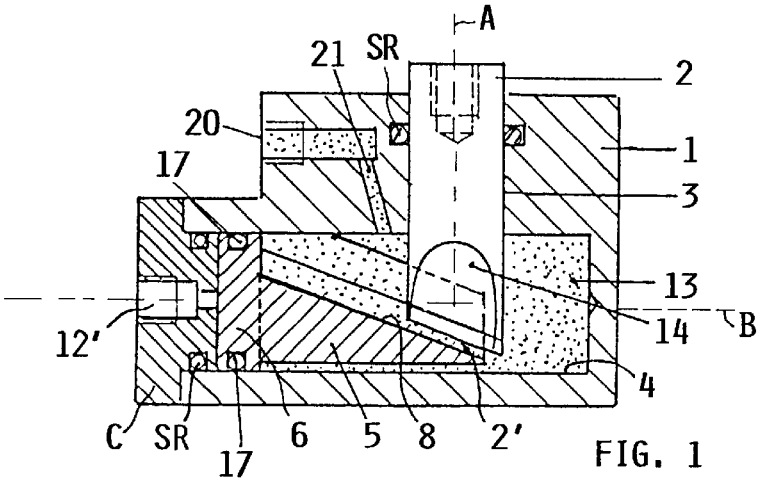
FIG. 1 shows an axial sectional view through the workpiece holding device according to the invention in its released or rest position.

FIG. 1 shows a central sectional view through a workpiece holding device or tool according to the invention including a housing 1 with a first bore 3 in which a clamping bolt 2 is slidingly received to extend out of the housing 1. A sealing ring SR seals the bore 3 around the bolt 2. The bolt is movable up and down along its central axis A. A second bore 4 in the housing 1 extends crosswise, preferably at a right angle relative to the first bore 3. The second bore 4 is preferably a dead-end bore or else closed by a cover not shown. The dead-end bore has a central axis B that intersects the central axis A, preferably at a right angle. The bore 4 forms a cylinder for a locking piston 6 having a piston rod 5 connected to the piston 6 which is sealed in the cylinder bore 4 by a sealing ring 17. The left-hand end of the bore 4 is closed by a cover C also sealed against the housing by a sealing ring SR. The cover C is provided with a pressure inlet port 12' for supplying fluid under pressure into a chamber 12 shown in FIG. 2 for moving the piston 6 with its rod 5 from the rest position shown in FIG. 1 into the working position shown in FIG. 2 as will be explained in more detail below.

In FIG. 1 fluid under pressure is introduced through a pressure inlet port 20 into a chamber 13 on the rod side of the piston 6 to move the piston 6 with its rod 5 into the shown leftmost position in which the clamping bolt 2 is disengaged from a workpiece not shown. A fluid duct 21 connects the pressure inlet 20 with the chamber 13.

Figure 2:
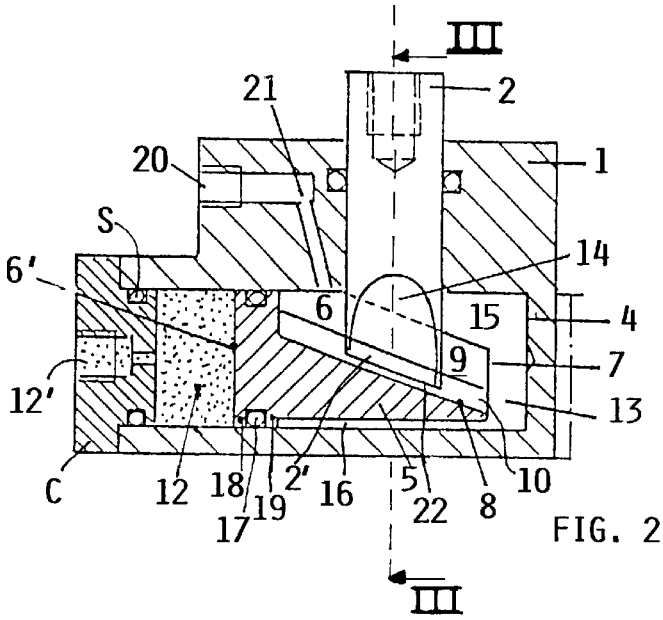
FIG. 2 is a sectional view as in FIG. 1, but showing the present holding device in a working position in which the piston and piston rod assume a self-locking condition.
Figure 3:
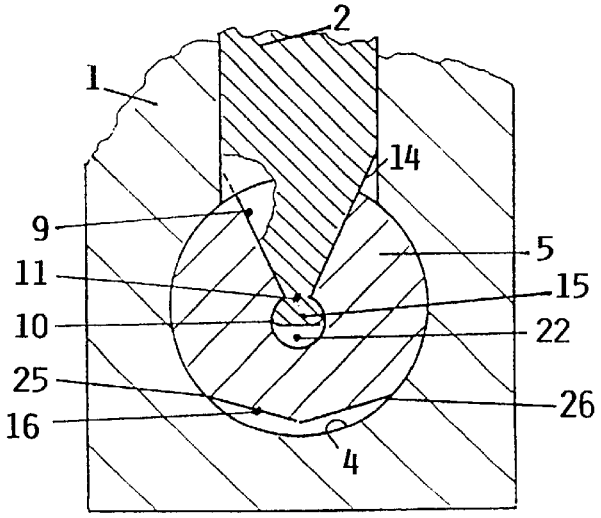
FIG. 3 is a sectional view along section line III—III in FIG. 2, wherein the groove portions of the tongue and groove combination are provided in the piston rod while the tongue sections are provided at the lower or inner end of the clamping bolt.

The piston 6 is a double acting piston having a first piston surface 6' facing into the pressure chamber 12 and a piston rod 5 with a surface 7 facing into the chamber 13 as best seen in FIG. 2. The piston rod 5 is provided with a first wedging incline 8 and the inner or lower end of the clamping bolt 2 is provided with a second wedging incline 2' which cooperates with the incline 8. As best seen in FIG. 3 a V-groove 9 extends in parallel to the wedging incline 8 and has a constant depth. Below the V-groove forming a first portion of the groove is a second groove portion, for example in the form of a bore 10 extending along or parallel to the V-groove. The two groove portions 9 and 10 communicate through an open neck 11 forming a longitudinal gap between the groove portions 9 and 10. The two groove portions 9 and 10 together form a guide track for the tongue sections 14 and 15.

The guide track extends along the piston rod 5 sufficiently to permit the movement of the bolt 2 from the position of FIG. 1 into the position of FIG. 2 by admitting fluid under pressure through the port 12' into the chamber 12. When the clamping action is to be released, pressurized fluid enters into the chamber 13 to move the piston and its rod back into the position of FIG. 1.

The two tongue sections 14 and 15 formed along the second incline 2' of the clamping bolt 2 are dimensioned exactly to conform to the groove portions 9 and 10, except that a projection or cam 15 forming the second tongue section is flattened to leave a fluid flow channel 22 in the groove portion 10. Fluid under pressure in the chamber 13 passes through the fluid flow channel 22 thereby facilitating the separation of the clamping bolt 2 from the piston rod 5. The slope of the wedging surfaces of the tongue section 14 corresponds to the slope of the V-groove 9 to permit the required sliding motion. The neck portion 11 assures that the clamping bolt 2 cannot be pressed out of engagement with the piston rod 5. The cam or projection 15 forms a guide member that is insertable into the groove portion 10 when the components of the clamping device are assembled.

As best seen in FIG. 3, the piston rod 5 is provided at its bottom facing away from the groove with at least one flat surface 16 to form two edges 25 and 26 extending along the piston rod 5. A space is provided between the inner wall of the bore 4 and the flat surface 16. This space is open to the chamber 13 so that fluid under pressure can enter into this space below the flat surface 16. This space ends next to the piston 6 near the sealing ring 17 as shown in FIG. 2. The sealing ring 17 is held in a groove between two piston rings 18 and 19 which are so dimensioned that the edges 25 and 26 can be wedged against the inner surface of the cylinder bore 4. Thus, the piston rings 17 and 18 preferably have a diameter which is slightly smaller than the diameter of the piston rod 5. This term "slightly smaller" is satisfied if the edges 25 and 26 of the piston rod 5 can bear against the cylinder wall without hindrance by the piston 6. This minute play between the piston rings 18 and 19 and the inner cylinder wall is of no consequence with regard to the establishment of the required pressures in the chambers 12 or 13, because the sealing ring 17 provides the required seal and the ring 17 is sufficiently elastic to permit the piston rod 5 to be wedged against the inner surface of the cylinder bore 4 to achieve the desired self-locking effect.

In operation, when pressure is admitted through the port 12' the piston 6 with its rod 5 will be moved to the right, thereby pushing its piston rod with its wedging incline 8 under the clamping bolt 2 which in response to this pushing action slides upwardly in the bore 3 and thereby extends sufficiently out of the housing 1 for supporting a workpiece not shown. As soon as the clamping bolt 2 contacts the workpiece, the piston 6 with its rod 5 clicks into a self-locking position by bearing with the edges 25, 26 of the flattened surface 16 against the inner wall of the cylinder bore 4. In this condition the clamping bolt 2 bears with its wedging surfaces 14 onto the flanks of the V-groove 9. Due to the wedging of the piston rod 5 with its edges 25, 26 against the inner cylinder wall of the cylinder bore 4, a self-locking effect is established between the clamping bolt 2, the piston rod 5 and the housing 1 resulting in a rigid structure that is free of any elastic yielding. Reaction forces caused by machining forces applied to the workpiece do not have any influence on the clamping bolt 2, even if the hydraulic pressure in the chamber 12 is released no matter for what reasons. This is so because of the self-locking effect between the wedging surfaces 14 and the V-groove 9 on the one hand and the edges 25, 26 of the flattened surface 16 of the piston rod 5 relative to the inner cylinder wall of the bore 2. Thus, any releasing motion of the piston 6 with its rod 5 to the left is prevented as long as the chamber 13 is not pressurized.

If the self-locking and thus the clamping bolt 2 are to be released, fluid under pressure is introduced to the inlet port 20 and enters the chamber 13 through the duct 21 and through the fluid flow channel 22, whereby hydraulic fluid under pressure in the chamber 13 is effective on all surfaces of the piston 6 and piston rod 5, namely the end surface 7 and the flat surface 16 as well as the wedging incline surface 8 in the bore 10 below the flattened cam or projection 15 of the clamping bolt 2. The fluid pressure in the fluid flow channel 22 slightly lifts the clamping bolt 2 whereby the piston 6 with its rod 5 is released from the self-locking effect and returned into the starting position shown in FIG. 1. Further, the release of the self-locking effect by slightly lifting the clamping bolt 2 permits an easy sliding motion along the groove portions 9 and 10, whereby the clamping bolt 2 can be moved out of its workpiece holding position into a retracted position shown in FIG. 1, due to the cooperation between the groove portions 9, 10 forming the neck 11 and the surfaces of the cam or projection 15 facing the fluid under pressure in the fluid flow channel 22.

Figure 4:
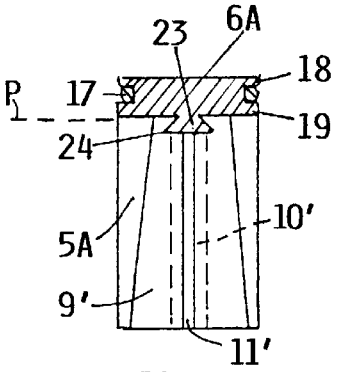
FIG. 4 is a modified piston and piston rod assembled of two separate elements.

FIG. 4 shows another embodiment of a piston 6A with a separate piston rod 5A. The piston 6A comprises a dovetail 23 and the piston rod 5A comprises a dovetail groove 24 in which the tail 23 is received to form an interlock when the piston 6A and the piston rod 5A are assembled to each other. In its preferred embodiment the piston 6A and rod 5A are separated along a plane P just below the lower piston ring 19 as seen in FIG. 4. The sealing ring 17 is held in a groove between the two piston rings 18 and 19. The piston rings 18 and 19 with the groove for the sealing ring 17 and the dovetail 23 are machined or formed as one piece and the piston rod 5A is formed as a separate piece, whereby the forming or machining operations are facilitated. When these operations are completed the two sections are assembled as described. The piston rod 5A is also provided with a V-groove 9' and a bore 10' interconnected by the neck 11'.

Figure 5:
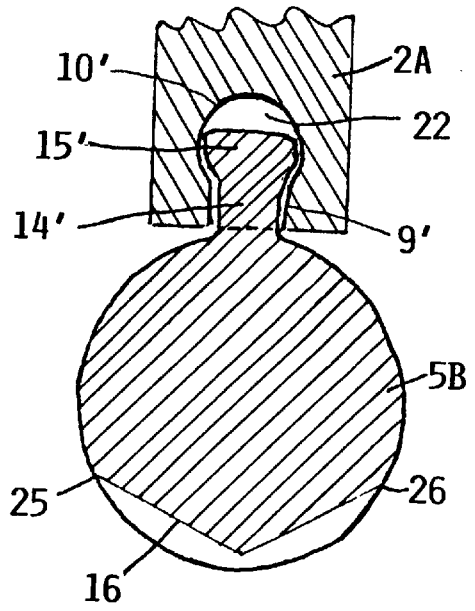
FIG. 5 is a sectional view similar to that of FIG. 3, but illustrating the tongue sections as part of the piston rod while the groove portions are provided at the inner end of the clamping bolt.
Figure 6:
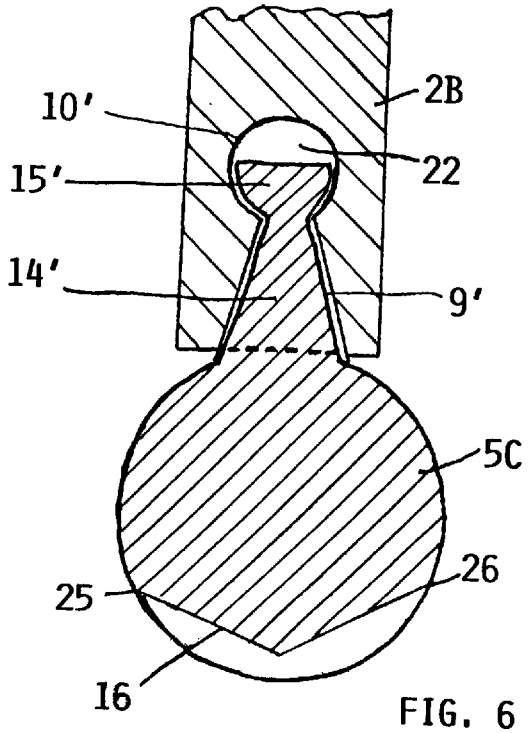
FIG. 6 is a view similar to FIG. 5 with modified tongue and groove configurations.

FIGS. 5 and 6 illustrate that the groove of the tongue and groove combination does not need to be in the piston rod. Rather, the groove portions can be formed in the clamping bolt 2A or 2B and the tongue sections can be formed on the piston rod 5B or 5C. In these embodiments the fluid flow channel 22 is also formed in the bolt 2A or 2B for releasing the self-locking effect as described above.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A self-locking device for clamping a workpiece to a supporting surface, said clamping device comprising a housing (1), a first bore (3) in said housing, a clamping bolt (2) slidable in said first bore and projecting out of said first bore for contacting said workpiece, a second bore (4) crossing said first bore (3) in said housing, a locking piston (6) slidably movable in said second bore (4) and dividing said second bore (4) into a first chamber (12) and a second chamber (13), said locking piston (6) including a piston rod (5) reaching into said second chamber (13), a first wedging incline (8) on said piston rod (5), a second wedging incline (2') on an inner end of said clamping bolt (2) cooperating with said first wedging incline (8) of said piston rod (5) for locking said clamping bolt (2) in a fixed position in response to moving said locking piston (6) and piston rod (5) into a bolt locking position, said clamping device further comprising a tongue and groove combination between said piston rod (5) and said inner end of said clamping bolt (2), said tongue and groove combination comprising a tongue (14,15) and a groove (9,10) wherein said tongue is guided in said groove in a force transmitting manner, said groove comprising a first groove portion (9) and a second groove portion (10) interconnected by an open neck (11), said tongue comprising a first tongue section (14) and a second tongue section (15) slidingly received in said first and second groove portions (9,10) for slidingly guiding said tongue in said groove when said locking piston (6) and piston rod (5) are moved relative to said clamping bolt (2), said housing comprising a first inlet (12') for admitting fluid under pressure into said first chamber (12) for moving said piston (6) and piston rod (5) into a bolt locking position, and wherein said housing comprises a second inlet (20,21) for admitting fluid under pressure into said second chamber (13) for driving said piston (6) and piston rod (5) into a bolt release position, and wherein said second groove portion (10) has a flow cross-sectional area that is larger than a cross-sectional area of said second tongue section (15) thereby forming a fluid flow channel (22) communicating with said second chamber (13) in said second bore (4), said fluid flow channel (22) extending between said tongue (14,15) and said groove (9,10) for admitting fluid under pressure from said second chamber (13) into said fluid flow channel (22) for separating said locking piston (6) and piston rod (5) from said clamping bolt (2) to thereby facilitate movement of said locking piston (6) and piston rod (5) into said bolt release position.

2. The self-locking device of claim 1, wherein said first and second groove portions (9, 10) are part of said piston rod (5), and wherein said first and second tongue sections (14,15) are part of said clamping bolt (2).

3. The self-locking device of claim 1, wherein said first and second groove portions (9', 10') are part of said clamping bolt (2A), and wherein said first and second tongue sections (14, 15) are part of said piston rod (5B, 5C).

4. The self-locking device of claim 1, wherein said first groove portion (9) is a V-groove and said second groove portion (10) forms said fluid flow channel (22), and wherein said clamping bolt (2) comprises at said lower end a wedge shape (14) forming said first tongue section slidingly fitting into said V-groove, and a projection (15) forming said second tongue section slidingly fitting into said fluid flow channel (22).

5. The self-locking device of claim 1, wherein said piston rod (5) comprises at least one flat section (16) extending along said piston rod (5) opposite said first wedging incline (8) as measured in an axial direction of said piston rod (5).

6. The self-locking device of claim 5, wherein said piston rod (5) has a given rod diameter, and wherein said locking piston (6) comprises two piston rings (18,19) and a circumferential groove between said two piston rings (18,19), a sealing ring (17) in said circumferential groove for sealing said locking piston (6) in said second bore (4), said piston rings (18, 19) having a ring diameter smaller than said given rod diameter (18, 19) along said at least one flat section (16) of said piston rod (5) for permitting said piston (6) and piston rod (5) to assume a self-locking when said piston (6) and piston rod are in a clamping position.

7. The self-locking device of claim 6, wherein said at least one flat section (16) of said piston rod (5) forms two edges (25, 26), which bear against an inner surface of said second bore (4) for said self-locking in response to a clamping action.

8. The self-locking device of claim 1, wherein said piston (6) and said piston rod (5) are a single piece structure.

9. The self-locking device of claim 1, wherein said piston (6A) and said piston rod (5A) are separate components, said separate components comprising an interlock (23, 24) holding said piston (6A) and piston rod (5A) together.

10. The self-locking device of claim 9, wherein said interlock comprises a dovetail joint (23, 24) between said piston (6A) and said piston rod (5A).

11. The self-locking device of claim 1, wherein said first bore (3) has a first central longitudinal axis (A) and wherein said second bore (4) has a second central longitudinal axis (B) extending at a right angle to said first axis (A) and intersecting said first axis (A).

12. The self-locking device of claim 1, wherein said first tongue section (14) comprises two incline surfaces extending at an acute angle to each other to form a wedge shape and wherein said second tongue section (15) forms a flattened tip of said wedge shape.

13. A self-locking device for clamping a workpiece to a supporting surface, said clamping device comprising a housing (1), a first bore (3) in said housing, a clamping bolt (2) slidable in said first bore and projecting out of said first bore for contacting said workpiece, a second bore (4) crossing said first bore (3) in said housing, a locking piston slidably movable in said second bore (4), said locking piston (6) including a piston rod (5), a first wedging incline (8) on said piston rod (5), a second wedging incline (2') on an inner end of said clamping bolt (2) cooperating with said first wedging incline (8) of said piston rod (5) for locking said clamping bolt (2) in a fixed position in response to moving said locking piston (6) and piston rod (5) into a bolt locking position, said clamping device further comprising a tongue and groove combination between said piston rod (5) and said inner end of said clamping bolt (2), said tongue and groove combination comprising a tongue (14,15) and a groove (9,10) wherein said tongue is guided in said groove in a force transmitting manner, said groove comprising first and second groove portions (9,10) interconnected by an open neck (11), said tongue comprising first and second tongue sections (14,15) slidingly received in said first and second groove portions (9,10) for slidingly guiding said tongue in said groove, when said piston (6) and piston rod (5) are moved relative to said clamping bolt (2), wherein said piston rod (5) comprises at least one flat section (16) extending along said piston rod (5) opposite said first wedging incline (8), and wherein said at least one flat section (16) of said piston rod (5) forms two edges (25, 26), which bear against an inner surface of said second bore (4) for self-locking said piston (6) and piston rod (5) in response to a clamping action.

14. The self-locking device of claim 13, wherein said first groove portion (9) is a V-groove and said second groove portion (10) forms a fluid flow channel (22), and wherein said clamping bolt (2) comprises at said lower end a wedge shape (14) forming said first tongue section slidingly fitting into said V-groove, and a projection (15) forming said second tongue section slidingly fitting into said fluid flow channel (22).

15. The self-locking device of claim 13, wherein said piston rod (5) has a given rod diameter, and wherein said locking piston (6) comprises two piston rings (18,19) and a circumferential groove between said two piston rings (18, 19), a sealing ring (17) in said circumferential groove for sealing said locking piston (6) in said second bore (4), said piston rings (18, 19) having a ring diameter smaller than said given rod diameter (18, 19) along said at least one flattened section (16) of said piston rod (5) for permitting said piston (6) and piston rod (5) to assume a self-locking when said piston (6) and said piston rod (5) are in a clamping position.

16. The self-locking device of claim 13, wherein said first tongue section (14) comprises two incline surfaces extending at an acute angle to each other to form a wedge shape and wherein said second tongue section (15) forms a flattened tip of said wedge shape.

17. The self-locking device of claim 13, wherein said flat section (16) extends along said piston rod (5) for an entire axial length of said piston rod (5).

* * * * *